US009951579B2

(12) United States Patent
Jones et al.

(10) Patent No.: US 9,951,579 B2
(45) Date of Patent: Apr. 24, 2018

(54) SINGLE-RUN WELL ABANDONING METHOD AND APPARATUS

(71) Applicant: Select Energy Systems Inc., Calgary (CA)

(72) Inventors: Kelly Jones, Calgary (CA); Scott Poole, Brooks (CA)

(73) Assignee: SELECT ENERGY SYSTEMS INC., Calgary, Alberta (CA)

( * ) Notice: Subject to any disclaimer, the term of this patent is extended or adjusted under 35 U.S.C. 154(b) by 0 days.

(21) Appl. No.: 15/343,376

(22) Filed: Nov. 4, 2016

(65) Prior Publication Data

US 2017/0130554 A1 May 11, 2017

Related U.S. Application Data

(60) Provisional application No. 62/252,040, filed on Nov. 6, 2015.

(51) Int. Cl.

| | |
|---|---|
| ***E21B 33/13*** | (2006.01) |
| ***E21B 33/12*** | (2006.01) |
| ***E21B 33/134*** | (2006.01) |
| ***E21B 17/06*** | (2006.01) |
| ***E21B 33/129*** | (2006.01) |

(52) U.S. Cl.

CPC ..... *E21B 33/134* (2013.01); *E21B 17/06* (2013.01); *E21B 33/1293* (2013.01)

(58) Field of Classification Search

CPC ..... E21B 23/01; E21B 23/06; E21B 33/1295; E21B 33/1293; E21B 33/134; E21B 33/124; E21B 33/127; E21B 33/129; E21B 33/13

See application file for complete search history.

(56) References Cited

U.S. PATENT DOCUMENTS

| | | | | |
|---|---|---|---|---|
| 3,872,925 | A * | 3/1975 | Owen | E21B 23/065 166/123 |
| 4,423,783 | A | 1/1984 | Haag | |
| 4,869,324 | A * | 9/1989 | Holder | E21B 23/06 166/123 |
| 5,469,918 | A | 11/1995 | Haberman | |
| 6,454,001 | B1 | 9/2002 | Thompson et al. | |
| 6,595,289 | B2 | 7/2003 | Tumlin et al. | |
| 2008/0314591 | A1 | 12/2008 | Hales et al. | |
| 2009/0183875 | A1 | 7/2009 | Rayssiguier et al. | |
| 2015/0275605 | A1 | 10/2015 | Bennett et al. | |

* cited by examiner

*Primary Examiner* — Zakiya W Bates

(74) *Attorney, Agent, or Firm* — McDonnell Boehnen Hulbert & Berghoff LLP

(57) ABSTRACT

A method and apparatus for sealing and filling a well which may form a part of a well abandoning operation. A tube containing well filler material is connected to a bridge plug by a connector so that the bridge plug can be positioned by moving the tube and then anchored. Once the bridge plug is anchored, the tube is disconnected and the well filler can be discharged into the well above the anchored bridge plug. In this way, the bridge plug anchoring and the filling of at least a portion of the well can be performed in a single run.

18 Claims, 6 Drawing Sheets

SINGLE-RUN WELL ABANDONING METHOD AND APPARATUS

RELATED APPLICATIONS

This application claims priority to U.S. Provisional Patent Application No. 62/252,040 which is hereby incorporated by reference.

FIELD OF THE INVENTION

The invention relates to a method and apparatus for sealing and at least partially filling a well, particularly in the oil and gas sector. In particular the invention relates to a downhole tool configured to allow a bridge plug to be positioned within a well and anchored in place; and to allow the well at least partially filled with filling material.

BACKGROUND OF THE INVENTION

In the oil and gas sector, for example, wells are abandoned because they are no longer needed to support oil and gas development or because an operator's mineral lease has expired.

There are a number of requirements to ensure that an abandoned well is safe and does not damage the surrounding environment. Each jurisdiction may have different requirements. For example, in Alberta, Canada, under Directive 020: Well Abandonment, the Alberta Energy Regulator has set strict requirements for environmental protection and public safety in areas around abandoned wells. However, many jurisdictions require that abandoned wells be sealed and at least partially filled.

There are a number of techniques available to the industry in regards to abandoning wells that are deemed to be past their life cycle. The current abandonment procedure can use coiled tubing, a service rig with jointed tubing, or wireline to deploy the abandonment plug and cement.

The procedure focused on here is using tubing to perform the abandonment. In the past, the first step would be to run a casing scraper to remove any build up of debris on the production casing. The scraper will remove any metal chards as a result of the perforating process that was performed to allow the hydrocarbons to flow into the well bore.

Once the scraper run has been completed, a permanent bridge plug is run into the well bore and set above the perforated zone that is being abandoned. This involves running the bridge plug into the wellbore on a hydraulic setting tool, collar locator, shear subsystem and grapple connector. A hydraulic pressure medium will be pumped activating the hydraulic setting tool thus setting the bridge plug with 30,000 lbs of force. All the equipment would then be removed from the wellbore.

The well bore would be pressure tested before the cementing process. Once a positive pressure test was completed the cementing process can begin. Prior to the running back into the hole, a pump down dart is inserted into the coiled tubing bore along with the spotting tool. A recommended amount of cement is pumped into the coiled tubing. The valve is closed trapping and containing the cement in the coiled tubing. The cementing equipment can now be run back into the wellbore, tagging the bridge plug. Hydraulic pressure medium pumps against the pump down plug which in turn creates pressure causing the valve in the spotting tool to shift, releasing the cement on top of the bridge. Hydraulic pressure is maintained as the bottom-hole assembly is pulled out of the hole and cement is continually pumped. The bottom-hole assembly is then removed from the wellbore.

US 2008/0314591 (Hales et al.) discloses a method of abandoning a well including the steps of: assembling a tool string including a perforating gun interconnected between first and second packer assemblies; conveying the tool string into a wellbore in a single trip; setting the first packer assembly; setting the second packer assembly; firing the perforating gun; and flowing cement into an annulus longitudinally between the first and second packer assemblies.

US 2009/0183875 (Rayssiguier et al.) discloses an apparatus to be lowered in a borehole, comprising: (i) a delivery section for delivering a plugging fluid; (ii) a setting section comprising a longitudinal element and a flexible and permeable sleeve into which the plugging fluid is delivered; and (iii) a disconnect mechanism to allow the delivery section to be disconnected from the setting section, characterized in that the flexible sleeve is connected by at least one floating means to the longitudinal element.

US 2015/0275605 (Bennett et al.) discloses a downhole tool including a bridge plug releasably coupled to a casing cutting tool. The bridge plug may be set within a wellbore and the casing cutting tool may be used in a milling or perforating operation during a single downhole trip of the downhole tool.

U.S. Pat. No. 4,423,783 (Haag) discloses a method for plugging a well comprising (1) extending two sets of dogs on a bridge plug for engaging the sides of the well by releasing an expandable means, and (2) releasing a high pressure fluid for triggering and releasing the expandable means for extending the two sets of dogs for securing the bridge plug at the desired depth in the well. A bridge plug for carrying out the method is also disclosed.

U.S. Pat. No. 5,469,918 (Haberman) discloses a device for suspension in a wellbore by means of cable with the device including a cement slurry containment means (such as bailer tube) a bridge plug, and a bridge plug retaining ring.

U.S. Pat. No. 6,454,001 (Thompson et al.) discloses a method and apparatus for plugging a well. The apparatus includes a well barrier which may be connected to a pipe string and lowered into a well to a selected plug location. The barrier is held in place by the pipe string at the selected plug location. The well barrier will engage the well at the selected plug location. A plugging fluid is displaced through the pipe string and is communicated into the well above the barrier. The well barrier will catch the plugging fluid. After the plugging fluid gels sufficiently to support itself in the well, the pipe string which was utilized to lower the well barrier can be disconnected from the well barrier and removed from the well after the plugging fluid has been allowed to set to a sufficient gel strength.

U.S. Pat. No. 6,595,289 (Tumlin et al.) discloses a method and apparatus for plugging a wellbore in a trip saving manner. In one aspect, embodiments comprise a cement retainer disposed on a run-in string and a radially expanded perforating assembly disposed below the cement retainer. In a single run, the apparatus provides for perforating a wellbore and squeezing cement through the perforations and into the surrounding formation.

SUMMARY OF THE INVENTION

According to the present disclosure, there is provided a downhole tool for filling at least a portion of a well, the downhole tool comprising:

a tube for containing well filler material and hydraulic fluid; and a tube-plug connector for connecting the tube to a bridge plug, the bridge plug having one or more anchors, wherein the bridge plug connector comprises a hydraulic actuator in fluid communication with the tube such that the actuator is configured to activate at least one anchor of a connected bridge plug in response to a pressure being applied to well filler material and hydraulic fluid in the tube, and wherein the tube-plug connector is configured to allow the tube to be disconnected from the anchored bridge plug such that the disconnected tube can deliver the well filler material into the well above the anchored bridge plug to fill at least a portion of the well.

This may allow the well bore to be sealed and at least partially filled in a single run.

The pressure may be transmitted through the well filler material to the hydraulic fluid. That is, the pressure may be applied at the top of the tube, transmitted through the well filler material to the hydraulic fluid.

The tool may comprise the bridge plug.

The hydraulic bridge plug may comprise at least one mechanical anchor configured to mechanically anchor the bridge plug against a well wall in response an anchor force being applied by the tube to the hydraulically anchored bridge plug.

The mechanical anchor may be a slip or slip assembly.

The tube-plug connector may be configured to disconnect from the anchored bridge plug in response to a disconnecting force being applied by the tube to the anchored bridge plug. The tube-plug connector may be configured to disconnect from the anchored bridge plug by shearing one or more shearing elements. The shearing elements may comprise one or more of: a shear pin and a shear screw.

The disconnecting force may be greater than the anchor force.

The well filler material may comprise cement.

The hydraulic fluid may comprise oil.

The tube may be configured such that the hydraulic fluid can be kept separate from the well filler material within the tube by a viscous material so that pressure applied to the well filler material may be transmitted to the hydraulic fluid via the viscous material. The tube may be configured such that the hydraulic fluid can be in direct contact with the well filler material. The viscous material may be grease plug. This may more easily allow the hydraulic fluid to be directed to the actuators in the bridge plug setting phase and the well filler fluid to be ejected after the bridge plug has been disconnected.

The tool may be configured such that:

in response to a hydraulic actuator pressure, fluid within the tube is directed to the hydraulic actuators of the tube-plug connector; and in response to a hydraulic occlusion pressure, fluid is prevented from being directed to the hydraulic actuators of the tube-plug connector, wherein the hydraulic occlusion pressure is greater than the hydraulic actuator pressure. This may prevent damaging components of the tool. For example, this may prevent damage to the pistons by over-pressurizing the fluid. It may also prevent well filler material entering into the actuator.

The tube may comprise coiled tubing.

The actuator may be configured to activate at least one slip of a connected bridge plug in response to a pressure being applied to well filler material and hydraulic fluid in the tube. Using slips may provide a secure anchor against the well bore wall.

The actuator may comprise a piston arm for transmitting a force applied to the hydraulic fluid to the anchors and wherein the actuators are configured such that the actuator and any contained hydraulic fluid remains part of the tube-plug connector after the bridge plug has been disconnected from the tube-plug connector. This may allow the piston arm (and possibly any hydraulic fluid stored therein) to be reused when setting other bridge plugs.

According to a further aspect, there is provided a filling system comprising a downhole tool as described herein, wherein the system comprises a pressure tester configured to apply a pressure inside the well prior to the tube being disconnected from the anchored bridge plug to test the quality of the bridge plug seal. This may allow the seal to be tested prior to well filler material being discharged into the well.

According to a further aspect, there is provided a downhole tool for filling at least a portion of a well, the downhole tool comprising:

a tube for containing well filler material; and a tube-plug connector configured to connect the tube to a bridge plug, the bridge plug comprising at least one anchoring mechanism configured, in response to the anchoring mechanism being activated, to anchor the bridge plug against a well wall, wherein the tube-plug connector is configured to allow the tube to be disconnected from the anchored bridge plug such that the disconnected tube can deliver the well filler material into the well above the anchored bridge plug to fill the well.

According to a further aspect, there is provided a method of filling at least a portion of a well, the method comprising:

positioning a bridge plug having one or more anchors using a tube connected to the bridge plug by a tube-plug connector, the tube containing well filler material and hydraulic fluid; and actuating one or more hydraulic actuators of the bridge plug connector by applying a pressure to well filler material and hydraulic fluid to activate at least one anchor of a connected bridge plug, and disconnecting the tube from the anchored bridge plug such that the disconnected tube can deliver the well filler material into the well above the anchored bridge plug to fill at least a portion of the well.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION OF THE INVENTION

The present invention relates to a downhole tool which allows a bridge plug to be positioned within a well, anchored in place and the well at least partially filled with filling material in a single run. In particular, a method and apparatus for sealing and filling at least a portion of a well is disclosed with reference to the accompanying figures. This may form a part of a well abandoning operation and may substantially reduce the time required to abandon a well. In addition, where contractors charge for tubing based on the amount of tubing inserted and removed from the well, the cost may be reduced because the tubing need only be run in and out of the well once.

In particular, a tube containing well filler material is connected to a bridge plug by a tube-plug connector wherein the bridge plug can be positioned by moving the tube and then anchored. Once the bridge plug is anchored, the tube is disconnected and the well filler is discharged into the well above the anchored bridge plug. In this way, the bridge plug anchoring and the filling of at least a portion of the well can be performed in a single run.

Bridge Plug

Figure 1:
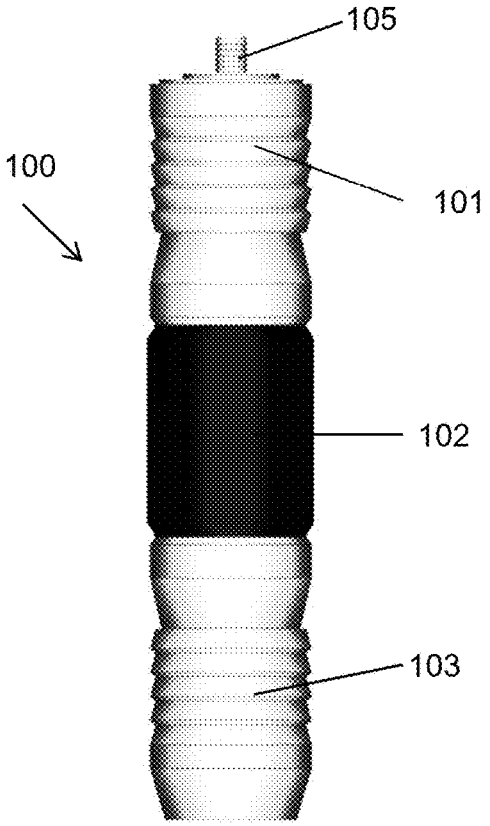
FIG. 1 is a side view of a bridge plug.

FIG. 1 shows a bridge plug 100 for sealing a well bore. In this case, the bridge plug 100 comprises two sets of anchors 101, 103 (e.g. slips). In this case, the bridge plug 100 comprises a hydraulic set of anchors 101 at the end closest to the tube-plug connector (top when in use in a vertical well) which are configured to be activated to anchor the bridge plug to the well interior in response to a piston (or other hydraulic actuator) moving the anchors along a sloped surface which drives the anchors out as the piston moves the anchors away from the tube-plug connector (downwards in a vertical well). In this case, the bridge plug further comprises a mechanical set of anchors 103 at the end farthest from the tube-plug connector (bottom when in use in a vertical well) which are configured to be activated to anchor the bridge plug to the well interior in response a central body portion of the bridge plug being drawn upwards with respect to the hydraulic set of anchors.

These anchors 101, 103, when anchored into the well bore, are configured to prevent motion of the bridge plug with respect to the well bore.

In this case, the bridge plug further comprises a packer section 102 made of flexible material (e.g. rubber or nitrile rubber). The packer material is configured to deform and expand laterally outwards in response to the central portion 105 of the bridge plug 100 being drawn upwards with respect to the hydraulic set of anchors. In this way, the packer 102 expands to impinge on the interior wall of the well and seal the well.

It will be appreciated that other bridge plugs may be anchored using only hydraulically activated anchors. Other bridge plugs may have anchors which are activated in other ways (e.g. by rotation).

Tube-Plug Connector

Figure 2B:
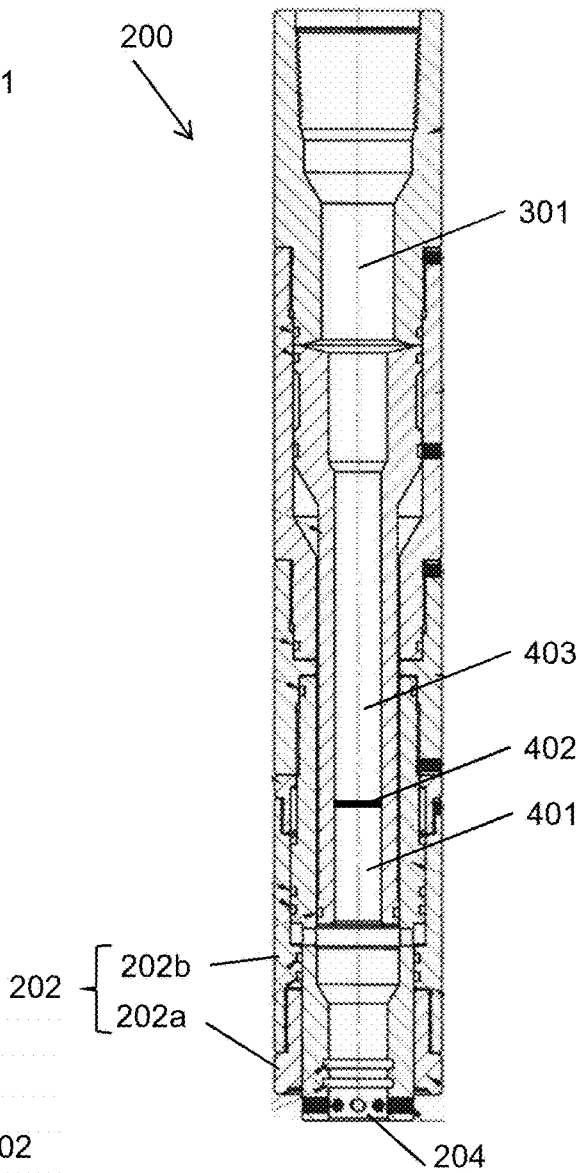
FIG. 2*b* is a cross section view of a tube portion and tube-plug connector prior to connection to a bridge plug.
Figure 2A:
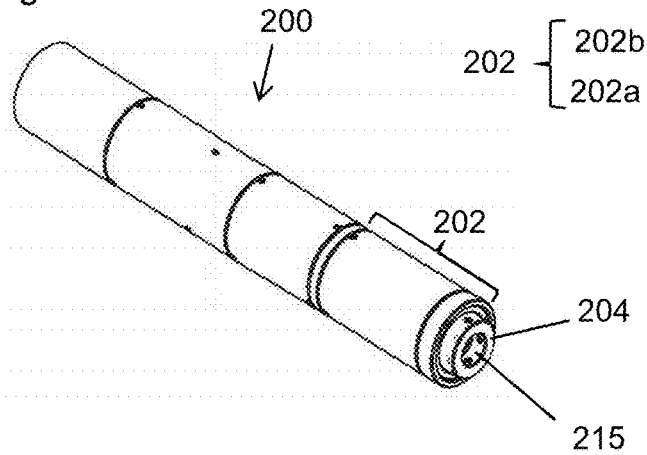
FIG. 2*a* is a side view of a tube portion and tube-plug connector prior to connection to a bridge plug.

FIGS. 2*a* and 2*b* shows a tube-plug connector 200 for connecting a tube for connecting to the bridge plug. In this case, the tube comprises coiled tubing.

In this case, the tube plug connector 200 comprises a central channel 301 for transmitting any fluids contained within the connected tube. In this case, the channel 301 in fluid communication with the connected tube may be considered to be an extension of, and so part of, the tube. It will be appreciated that, in other embodiments, the channel may or may not be located centrally. In this case, the tube is filled with well filler material 403 (e.g. cement) and hydraulic fluid 401 (e.g. oil). It will be appreciated that the hydraulic fluid and the well filler material should be able to flow within the pipe. Therefore, the materials within the tube may be comprise one or more of, for example: liquid; gel; a slurry; solid particulates suspended in a liquid; a granular material capable of flow (e.g. sand); and soft solids (e.g. grease).

In this case, the hydraulic fluid 401 is at the end of the tube so that it will be discharged first. The hydraulic fluid 401 and the well filler material 403 are, in this case, separated by a grease plug 402 to ensure that they are not mixed together. It will be appreciated that, depending on the nature of the hydraulic fluid and the well filler material, such a separating means 402 may not be required.

In addition, in this case, the tube-plug connector comprises an adjustable length piston 202 configured to activate at least one anchor of a connected bridge plug in response to a pressure being applied to well filler material and hydraulic fluid in the tube.

In this case the piston is adjustable in length by having two portions 202*a*, 202*b* connected by a screw thread. That is, when the first portion of the piston 202*a* is rotated with respect to the second piston portion 202*b*, the effective length of the piston 202 can be changed. It will be appreciate that other embodiments may not have an adjustable piston, and that other embodiments may have different mechanisms for adjusting the length of the piston.

As will be discussed in greater detail below, the end of the channel is in the form of a cylindrical portion 204. This cylindrical portion is configured to receive a male portion for attaching to the bridge plug. The male portion is held in place within the cylindrical portion, in this case, by a plurality of shearing elements (not shown). When the male portion is attached, the male portion prevents fluids within the channel from being discharged through the well filler material port 215 (e.g. the well filler material port 215 is sealed). When the shearing elements are sheared and the male portion removed, the well filler material may be discharged through the well filler material port 215. It will be appreciated that other embodiments may only have one shearing element.

The tube-plug connector may be formed of iron, cast iron and/or steel.

Tube

The tube may comprise coiled or jointed tubing. The tube may be formed from a flexible or ridged material. The tube may be formed from an inelastic material to facilitate applying a force to a connected bridge plug and/or tube-plug connector by pulling on the tube.

Coiled tubing may comprise metal pipe (e.g. 1 to 4 inches or 2.5 to 10 cm) in diameter which is supplied spooled on a large reel.

Connecting the Bridge Plug

Figure 3:
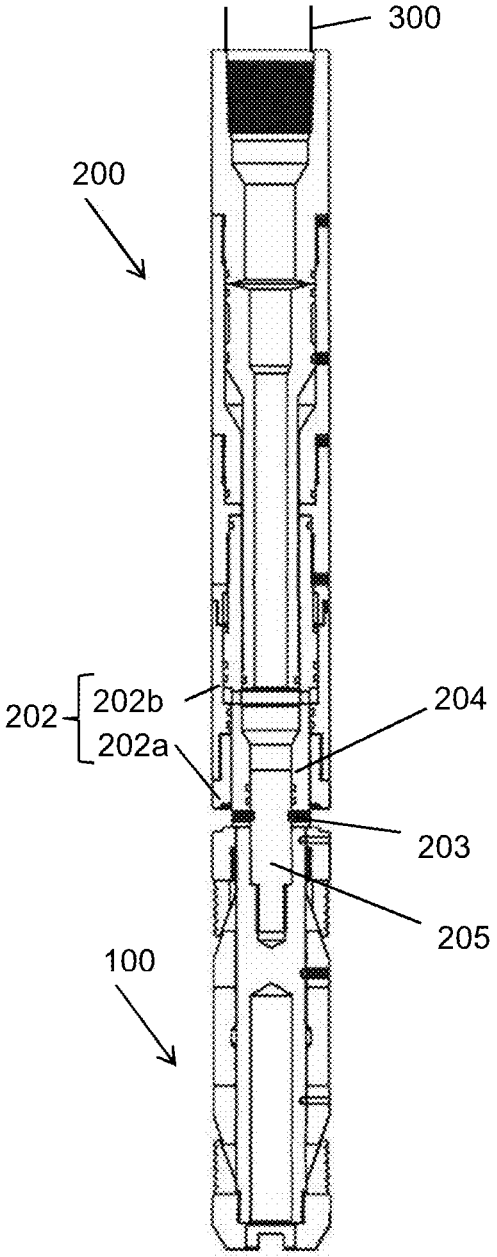
FIG. 3 is a cross-section of a tube-plug connector and a connected bridge plug prior to insertion into a well.

FIG. 3 shows the first stage of connecting the bridge plug to the tube-plug connector. This stage may take place above ground. In this stage, a male portion 205 of the tube-plug connector is screwed into a female portion of the tube-plug connector. It will be appreciated that other methods of connecting the bridge plug to the tube-plug connector may be used (e.g. bolts).

In this case, the male portion of the tube-plug connector is connected to the rest of the tube-plug connector using one or more shearing elements 203 (e.g. shear screws or shear pins). The shearing elements may be formed from brass. In this case, the shearing elements are shear pins which are inserted (e.g. screwed) radially inwards through a cylindrical portion 204 of the tube-plug connector such that the shear pins are arranged perpendicular to the axis of the tube-plug connector and to extend into a groove in the male pin 205 which connects to the bridge plug. When the shear pins 203 are in position if the tube-plug connector 200 is moved along the axis relative to the bridge plug 100, the side of the groove in the male pin and the inner surface of the cylindrical portion apply a shear the shear pins which allows the male pin 205 (and connected bridge plug) to separate from the rest of the tube-plug connector. It will be appreciated that the male portion 205, in this case, may be considered as a disposable (and/or replaceable) part of the tube-plug connector or as a part of the bridge plug.

Figure 4:
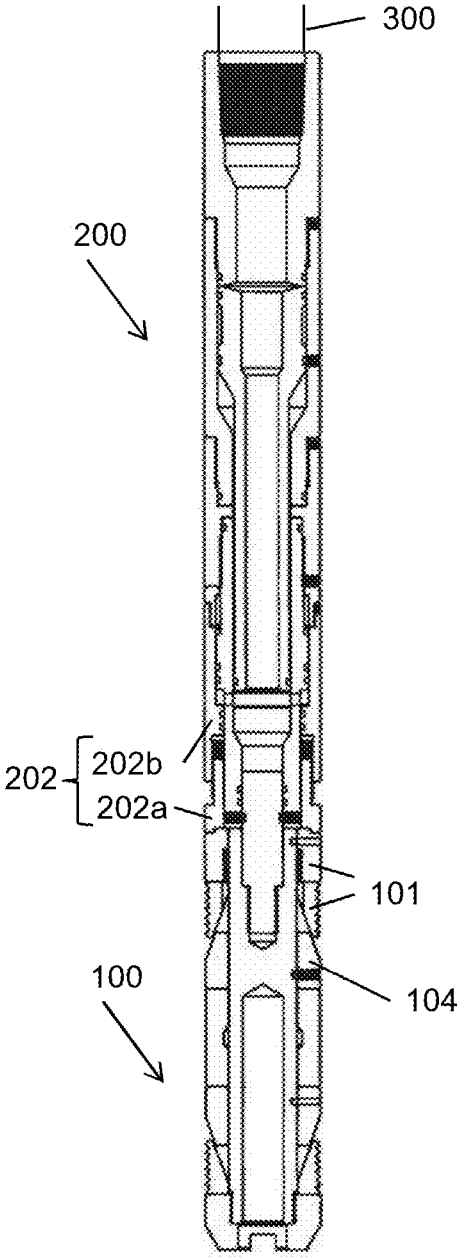
FIG. 4 is a cross-section of a tube-plug connector and a connected bridge plug during positioning of the bridge plug.

Then, the length of the piston is changed such that when the piston is in the retracted position, the distal end of the piston impinges on the bridge plug anchors 101. This is shown in FIG. 4.

Then the bridge plug 100, tube-plug connector 200 and tube 300 are inserted into the well bore 500. The bridge plug 100 is positioned by inserting the appropriate length of tube into the well bore (e.g. inserting the appropriate length of coiled tubing).

Anchoring the Bridge Plug

When the bridge plug 100 is positioned at the correct depth (e.g. above the perforated zone that is being abandoned), a hydraulic actuator pressure is applied to the well filler material and hydraulic fluid within the tube 300. The hydraulic pressure may be in the region of 500-1500 psi (~3.5-10 MPa, e.g. 1000 psi or 7 MPa). When the hydraulic actuator pressure is being applied the hydraulic fluid at the end of the tube flows through the channel within the tube-plug connector and through port holes 202*d* (or other channels) into one or more hydraulic actuator chambers 202*c*. In this case, this impels the hydraulic actuator piston away from the tube-plug connector and towards the hydraulic set of anchors on the bridge plug.

Figure 5:
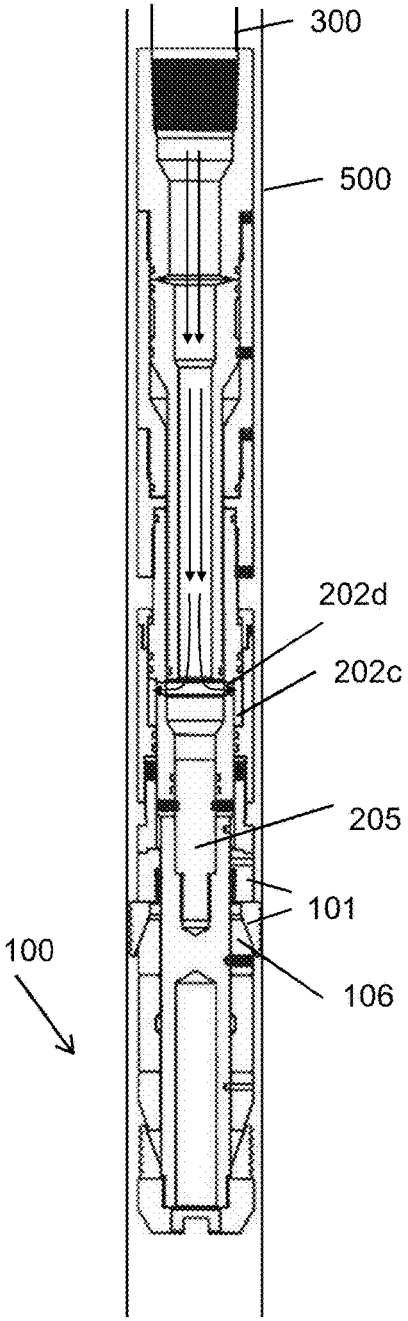
FIG. 5 is a cross-section of a tube-plug connector and a connected bridge plug after hydraulic anchors have been activated.

Because the hydraulic set of anchors 101 are, in this case, mounted on an inclined surface 106, as the hydraulic actuator piston impels the hydraulic anchors away from the tube-plug connector (downwards), the hydraulic anchors are impelled outwards to impinge on the interior of the well bore 500. This anchors the bridge plug 100 against the well 500 and prevents movement of the bridge plug 100 along the axis of the well bore 500. This is shown in FIG. 5.

Figure 6:
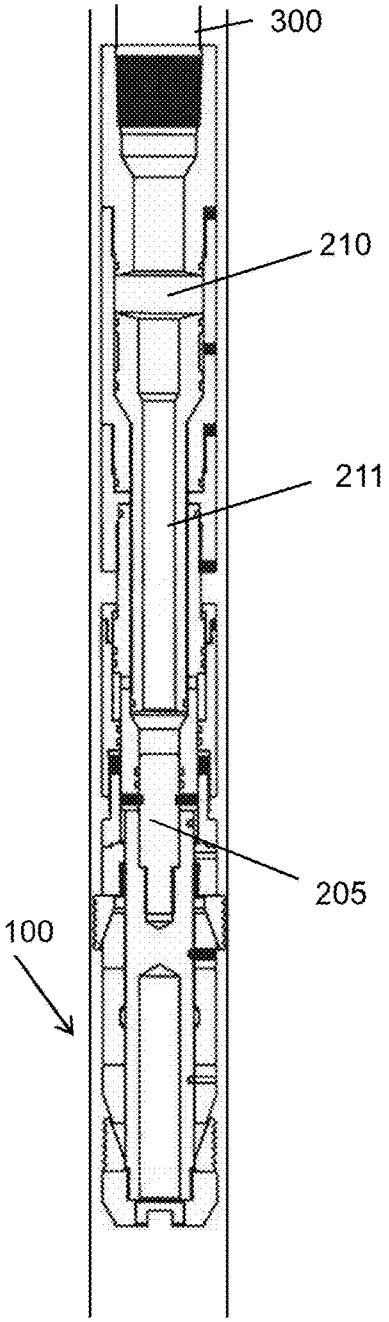
FIG. 6 is a cross-section of a tube-plug connector and a connected bridge plug after the hydraulic actuators of the tube-plug connector have been disconnected.

Then, as shown in FIG. 6, the pressure on the fluid within the tube is increased to a hydraulic occlusion pressure. The hydraulic occlusion pressure may be in the region of 1700 psi (12 MPa e.g. between 1500-2000 psi or 10-14 MPa). In this case, when the hydraulic occlusion pressure is applied to the fluid, an expansion chamber 210 within the central channel is expanded such that the channel sleeves 211 below this expansion chamber 210 are displaced towards the bridge plug (downwards) such that port holes to the hydraulic actuator chamber 202*c* are occluded. This means that fluid can no longer be transmitted from the tube 300 to the hydraulic actuator chamber 202*c*. This means that, when the well filler material is ready to be pumped, the well filler material cannot be pumped into the hydraulic actuator chamber 202*c*. It will be appreciated that, in some embodiments, the ports to the hydraulic actuator chamber may not be occluded (e.g. relying on the hydraulic fluid to prevent the filler material entering the chamber) or occluded in a different way (e.g. by an electronically closing a valve).

Figure 7:
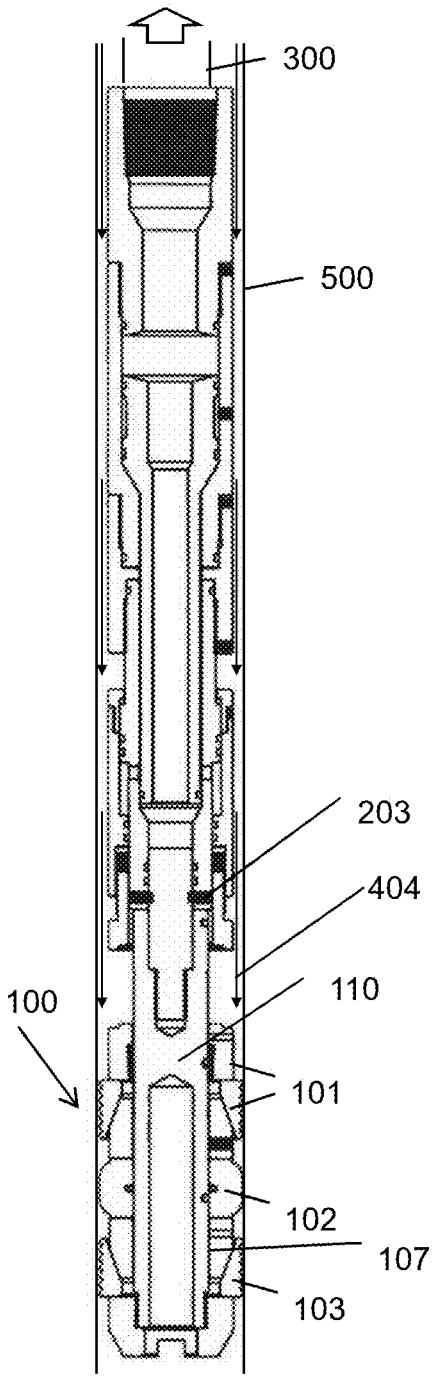
FIG. 7 is a cross-section of a tube-plug connector and a connected bridge plug after mechanical anchors have been activated.

In this case, although the bridge plug is anchored using the hydraulically activated anchors 101, the well bore 500 is not yet sealed. In order to seal the well 500, the tube 300 and tube-plug connector 200 is drawn upwards as shown in FIG. 7. This causes the still connected body of the bridge plug 110 to be drawn upwards with respect to the anchored hydraulic anchors 101 with an anchor force The anchor force may be around 14,000 lbs force (~60,000 N). As the body 110 of the bridge plug is drawn upwards with respect to the hydraulic anchors 101, the mechanical anchors 103 are configured to slide along an inclined surface 107 such that as they are drawn towards the hydraulic anchors 101, they move out to impinge on the well bore interior 500. This results in the bridge plug 100 being anchored at the top by the hydraulic anchors 101 and at the bottom by the mechanical anchors 103.

In addition, as the mechanical anchors 103 move towards the hydraulic anchors 101, the flexible packing material 102, which is disposed between the mechanical anchors 103 and the hydraulic anchors 101, is compressed axially which causes the packing material to extend laterally outwards to form a seal with the well bore 500. At this stage the bridge plug 100 is fixed in position and is sealing the well bore 500.

Seal Testing

In this case, to test the seal before the bridge plug is disconnected, a testing fluid 404 is pumped into the annulus between the tube and the well bore 500 from the top of the well. The testing fluid may comprise a liquid (e.g. water) or a gas (e.g. $N_2$ or air). For example, a pressure test may comprise pressurizing the annulus at 1000 psi (7 MPa) for 10 minutes. This helps ensures that the bridge plug is securely fixed in place and is sealing the well bore sufficiently before the filling material is introduced.

It will be appreciated that, in some embodiments, the seal test may be omitted.

Disconnecting the Bridge Plug

Figure 8:
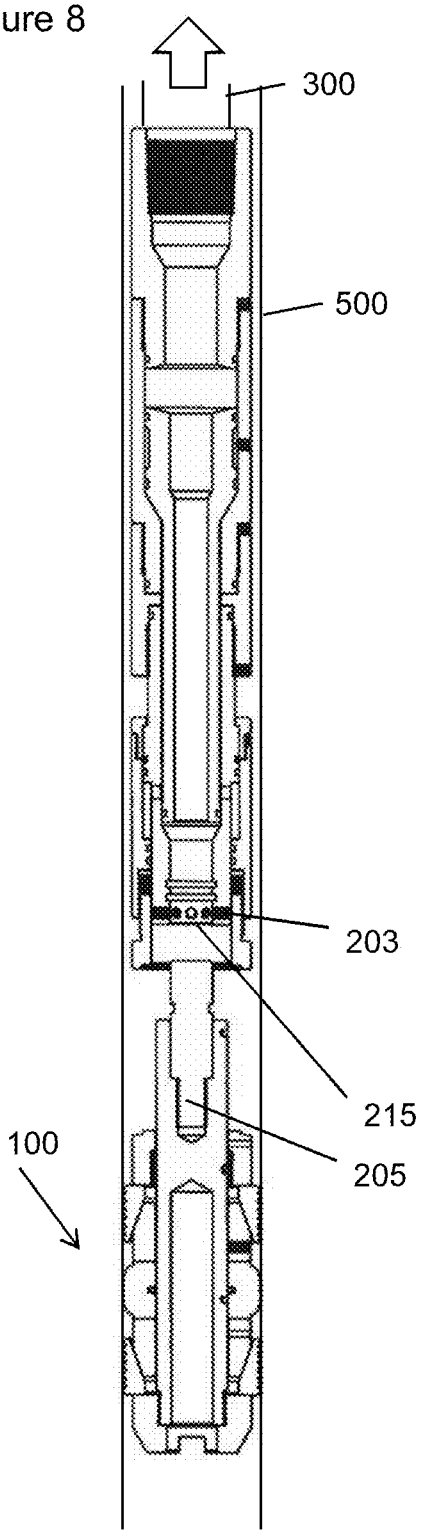
FIG. 8 is a cross-section of a tube-plug connector and the anchored bridge plug after the tube-plug connector has been disconnected.

If the test is successful, as shown in FIG. 8, a disconnecting force is applied to the tube drawing it upwards. The disconnecting force may be in the range of 16,000 lbf (~70,000 N). This force is configured to shear the shearing elements 203 connecting the bridge plug 100 to the tube-plug connector 200. By shearing the shearing elements 203, a well filler material port 215 is opened.

Figure 9:
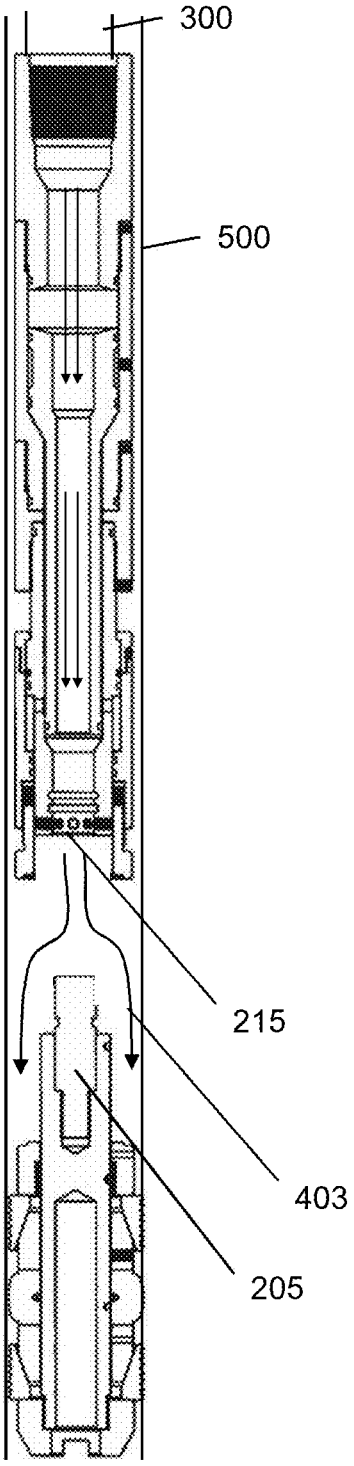
FIG. 9 is a cross-section of a tube-plug connector and the anchored bridge plug after the tube-plug connector has been disconnected showing how well filler material is discharged into the well bore.
Figure 10:
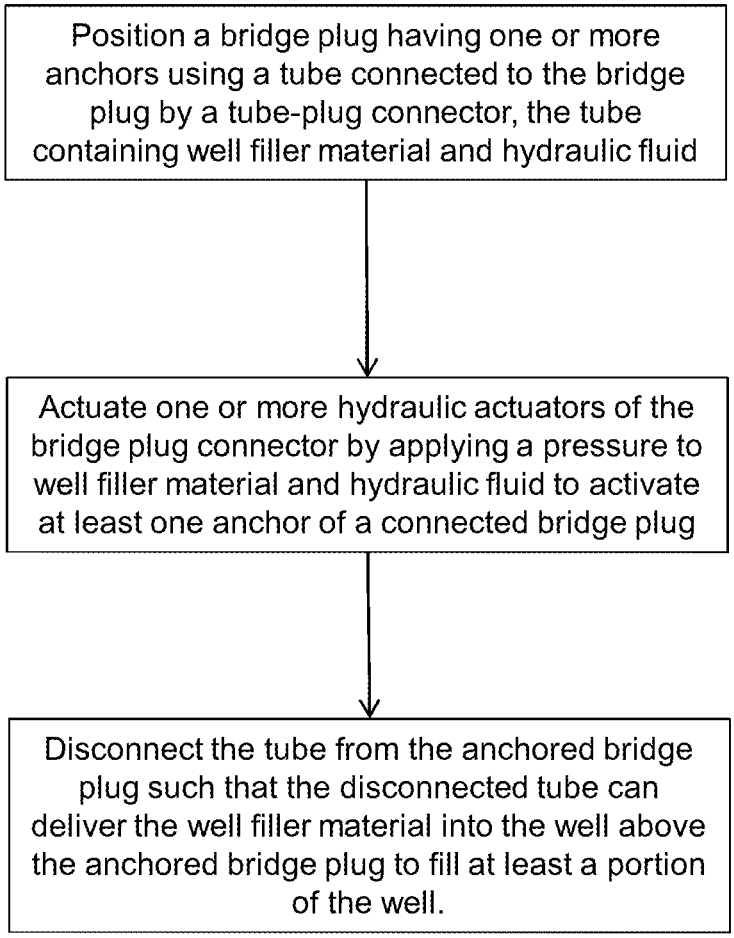
FIG. 10 is a flow chart showing the method of sealing and at least partially filling a well.

As shown in FIG. 9, this allows well filler material 403 to be discharged from the tube through the tube-plug connector channel. This allows the well filler material 403 to be discharged from the tube to fill at least a portion of the well from the bottom up as the tube and well-plug connector is retracted from the well. For example, the tube may initially contain and discharge well filler material sufficient to fill the bore hole to a height of 8 feet (2.5 meters).

Other embodiments may be configured to disconnect the bridge-plug from the tube-plug connector in different ways. For example, the tube-plug connector may be configured to disconnect electronically.

Although the present invention has been described and illustrated with respect to preferred embodiments and uses thereof, it is not to be so limited since modifications and changes can be made therein which are within the full, intended scope of the invention as understood by those skilled in the art. Each of the references cited herein is incorporated by reference in its entirety.

The invention claimed is:

1. A downhole tool for filling at least a portion of a well, the downhole tool comprising:

a tube for containing well filler material and hydraulic fluid; and a tube-plug connector for connecting the tube to a bridge plug, the bridge plug having one or more anchors, wherein the bridge plug connector comprises a hydraulic actuator in fluid communication with the tube such that the actuator is configured to activate at least one anchor of a connected bridge plug in response to a pressure being applied to well filler material and hydraulic fluid in the tube, and wherein the tube-plug connector is configured to allow the tube to be disconnected from the anchored bridge plug such that the disconnected tube can deliver the well filler material into the well above the anchored bridge plug to fill at least a portion of the well.

2. The tool of claim 1, wherein the tool comprises the bridge plug.

3. The tool of claim 2, wherein the hydraulic bridge plug comprises at least one mechanical anchor configured to mechanically anchor the bridge plug against a well wall in response an anchor force being applied by the tube to the hydraulically anchored bridge plug.

4. The tool according to claim 1 wherein the tube-plug connector is configured to disconnect from the anchored bridge plug in response to a disconnecting force being applied by the tube to the anchored bridge plug.

5. The tool of claim 4, wherein the tube-plug connector is configured to disconnect from the anchored bridge plug by shearing one or more shearing elements.

6. The tool of claim 5, wherein the shearing elements are one or more of: a shear pin and a shear screw.

7. The tool according to claim 4, wherein the disconnecting force is greater than the anchor force.

8. The tool according to claim 1, wherein the well filler material comprises cement.

9. The tool according to claim 1 wherein the hydraulic fluid comprises oil.

10. The tool according to claim 1 wherein the tube is configured such that the hydraulic fluid can be kept separate from the well filler material within the tube by a viscous material so that pressure applied to the well filler material may be transmitted to the hydraulic fluid via the viscous material.

11. The tool according to any one of claim 10 wherein the viscous material comprises a grease plug.

12. The tool according to claim 1 wherein the tool is configured such that:

in response to a hydraulic actuator pressure, fluid within the tube is directed to the hydraulic actuators of the tube-plug connector; and in response to a hydraulic occlusion pressure, fluid is prevented from being directed to the hydraulic actuators of the tube-plug connector, wherein the hydraulic occlusion pressure is greater than the hydraulic actuator pressure.

13. The tool according to claim 1 wherein the tube comprises coiled tubing.

14. The tool according to claim 1 wherein the actuator is configured to activate at least one slip of a connected bridge plug in response to a pressure being applied to well filler material and hydraulic fluid in the tube.

15. The tool according to claim 1, wherein the actuator comprises a piston arm for transmitting a force applied to the hydraulic fluid to the anchors and wherein the actuators are configured such that the actuator and any contained hydraulic fluid remains part of the tube-plug connector after the bridge plug has been disconnected from the tube-plug connector.

16. A filling system comprising the tool according to claim 1 wherein the system comprises a pressure tester configured to apply a pressure inside the well prior to the tube being disconnected from the anchored bridge plug to test the quality of the bridge plug seal.

17. A downhole tool for filling at least a portion of a well, the downhole tool comprising:

a tube for containing well filler material; and a tube-plug connector configured to connect the tube to a bridge plug, the bridge plug comprising at least one anchoring mechanism configured, in response to the anchoring mechanism being activated by pressure being applied to the well filler material, to anchor the bridge plug against a well wall, wherein the tube-plug connector is configured to allow the tube to be disconnected from the anchored bridge plug such that the disconnected tube can deliver the well filler material into the well above the anchored bridge plug to fill the well.

18. A method of filling at least a portion of a well, the method comprising:

positioning a bridge plug having one or more anchors using a tube connected to the bridge plug by a tube-plug connector, the tube containing well filler material and hydraulic fluid; and actuating one or more hydraulic actuators of the bridge plug connector by applying a pressure to well filler material and hydraulic fluid to activate at least one anchor of a connected bridge plug, and disconnecting the tube from the anchored bridge plug such that the disconnected tube can deliver the well filler material into the well above the anchored bridge plug to fill at least a portion of the well.

* * * * *